US008511757B2

(12) United States Patent
O'Neill

(10) Patent No.: US 8,511,757 B2
(45) Date of Patent: Aug. 20, 2013

(54) CORE BREAKER FOR A MINING MACHINE

(75) Inventor: Michael L. O'Neill, Lucinda, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 256 days.

(21) Appl. No.: 13/040,579

(22) Filed: Mar. 4, 2011

(65) Prior Publication Data

US 2012/0223567 A1 Sep. 6, 2012

(51) Int. Cl.
*E21C 27/24* (2006.01)
*E21C 35/00* (2006.01)

(52) U.S. Cl.
USPC ..... 299/78; 299/79.1; 299/95; 299/101

(58) Field of Classification Search
USPC ..... 299/79.1, 78, 95, 101
See application file for complete search history.

(56) References Cited

U.S. PATENT DOCUMENTS

| | | | | |
|---|---|---|---|---|
| 3,010,708 | A | 11/1961 | Hlinsky et al. | |
| 3,050,291 | A | 8/1962 | Lundquist | |
| 3,279,856 | A | 10/1966 | Silks | |
| 4,076,316 | A | 2/1978 | LeBegue | |
| 4,253,705 | A | 3/1981 | LeBegue | |
| 4,391,472 | A | 7/1983 | Krekeler | |
| 4,669,786 | A | 6/1987 | Morgan et al. | |
| 5,143,423 | A * | 9/1992 | LeBegue et al. | 299/76 |
| 6,315,365 | B1 | 11/2001 | Gerer et al. | |
| 6,890,037 | B2 | 5/2005 | Stewart | |
| 7,036,890 | B2 | 5/2006 | Hill et al. | |
| 2010/0237684 | A1 | 9/2010 | Keller et al. | |

FOREIGN PATENT DOCUMENTS

| | | |
|---|---|---|
| WO | 2010036317 | 4/2010 |
| WO | 2011130690 | 10/2011 |

OTHER PUBLICATIONS

Search Report from the United Kingdom Intellectual Property Office for Application No. 1203601.8 dated Mar. 28, 2012 (4 pages).
Kennametal, Kennametal Corebreaker, Technical Sales Bulletin, Jan. 2, 2008, 1 page, Bedford, PA.

* cited by examiner

*Primary Examiner* — David Bagnell
*Assistant Examiner* — Michael Goodwin
(74) *Attorney, Agent, or Firm* — Michael Best & Friedrich LLP

(57) ABSTRACT

A core breaker positioned between cutting drums on a mining machine that includes a generally circular support member, and a beveled blade portion on the radial outward surface of the support member. The beveled blade portion includes a plurality of wedge-shaped portions and a plurality of serrated portions. Each wedge-shaped portion is connected to an adjacent wedge-shaped portion through a mediate serrated portion. Both the wedge-shaped portions and the serrated portions are generally beveled. The wedge-shaped portions and serrated portions maintain curvatures, giving the blade portion a generally undulated appearance. The blade portion has two faces, and can be beveled on a single face. Alternatively, the blade portion can be beveled on each face. The beveled surfaces can be substantially symmetrical or asymmetrical from a view in the radial direction of the generally circular support member.

15 Claims, 5 Drawing Sheets

CORE BREAKER FOR A MINING MACHINE

BACKGROUND

It is common in underground coal mining to use a mining machine having one or more large rotatable cutting drums equipped with teeth that continuously scrape coal from the seam. The mining machine typically includes a chassis, a boom mounted on the chassis, a laterally elongated mining head mounted on the boom, and a conveyor to transport the removed coal from the seam. In some cases, the cutting drums can be laterally spaced apart from one another along the length of the mining head. The boom of the mining machine can include support flanges that fixedly carry the cutting drums during the operation of the mining machine.

SUMMARY

The width of each support flange may leave a volume of earth-strata core uncut in the mined face, roof, or floor. The core material that is not cut or ripped can limit the penetration of the cutting teeth of the mining machine. To break or split the core material, a core breaker can be positioned between the cutting drums. The core breaker can include a plurality of bits that can break the core material into fragments, thereby eliminating the barrier to penetration of the teeth into the seam.

In some embodiments, a core breaker is positioned between cutting drums on a mining machine. The cutting drums rotate about a common axis. The core breaker includes a generally circular support member including a radially outward surface, at least a portion of which lies in a plane orthogonal to the axis. The core breaker further includes a beveled blade portion on the orthogonal portion of the radially outward surface.

In other embodiments, a mining machine includes a plurality of cutting drums that rotate about an axis. The mining machine further includes one or more support flanges, each support flange positioned between two cutting drums. In addition, the mining machine includes a core breaker mounted on at least one support flange. The core breaker includes a generally circular support member including a radially outward surface, at least a portion of which lies in a plane orthogonal to the axis. The core breaker further includes a beveled blade portion on the orthogonal portion of the radially outward surface.

In still other embodiments, a mining machine includes a plurality of cutting drums that rotate about an axis, one or more support flanges, and means for breaking up material between the cutting drums as the cutting drums cut into the material to be mined. Each support flange is positioned between two cutting drums.

It should be understood that the invention is not limited in its application to the details of construction and the arrangements of the components set forth in the following description or illustrated in the above-described drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Figure 1:
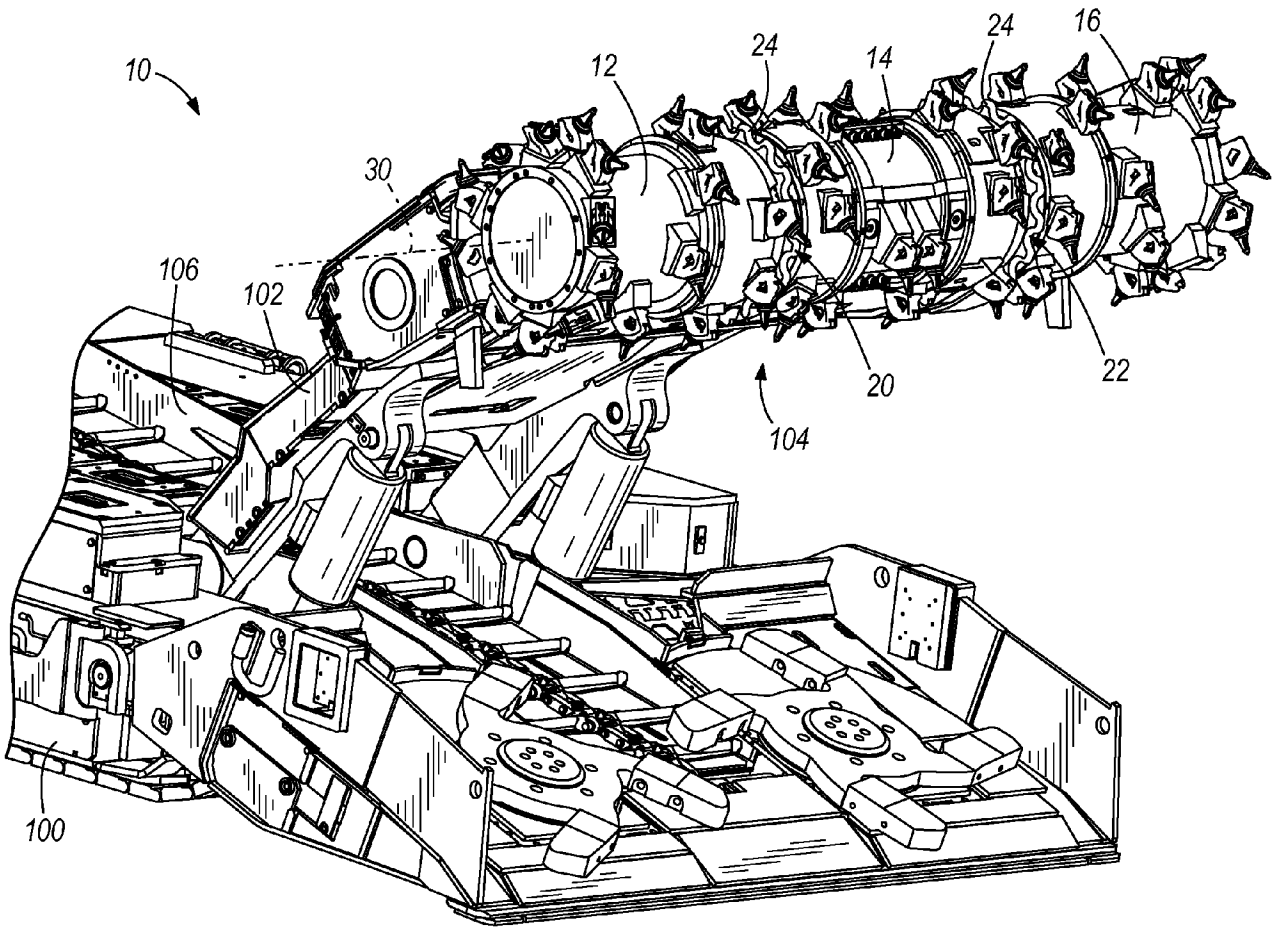
FIG. 1 is a perspective view of a portion of a mining machine that includes rotatable cutting drums and core breakers that are positioned between the cutting drums.
Figure 2:
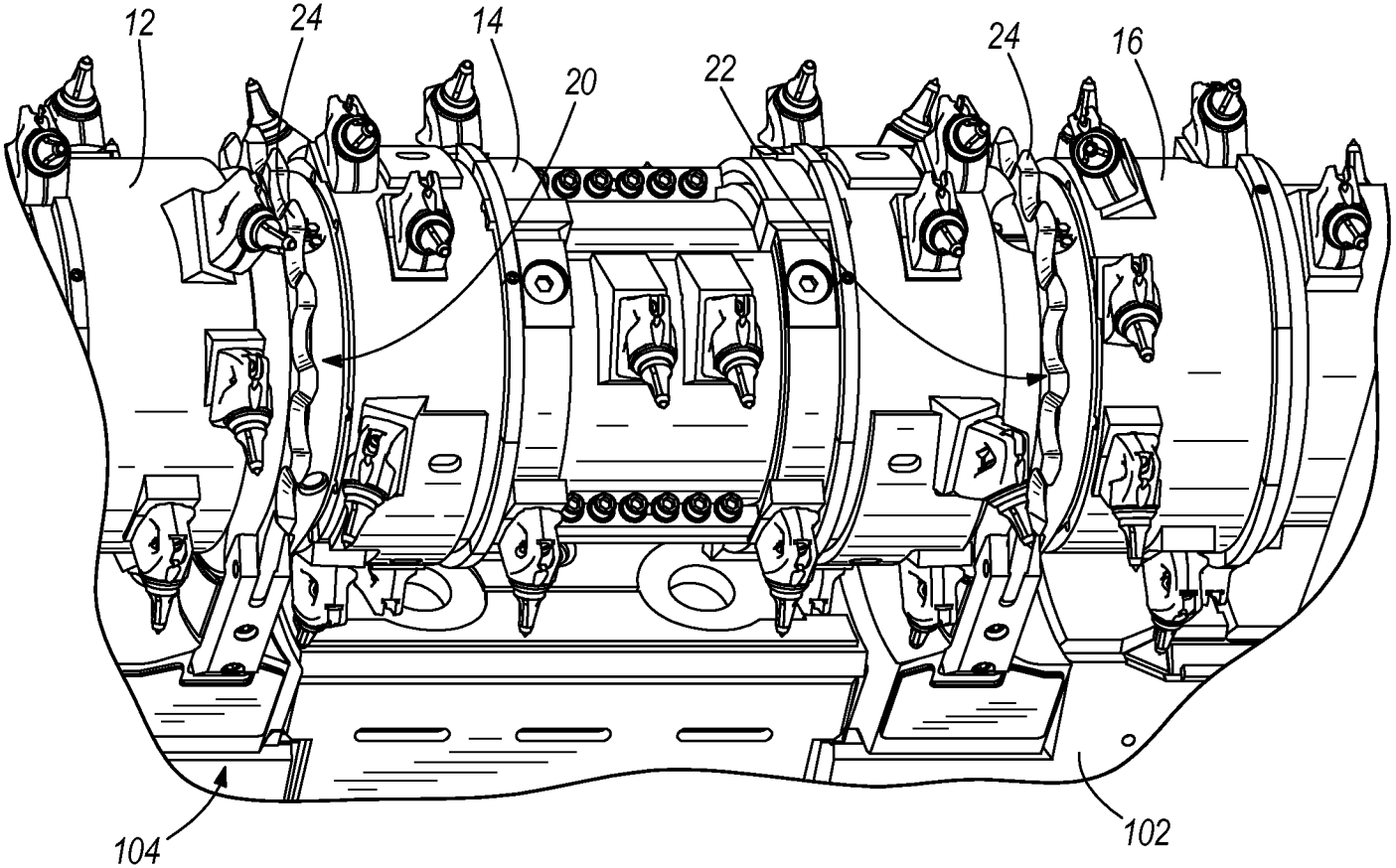
FIG. 2 is an enlarged perspective view similar to FIG. 1 illustrating the cutting drums and core breakers.

FIGS. 1 and 2 show a portion of a mining machine 10. The mining machine 10 includes a chassis 100, a boom 102 mounted on the chassis 100, a laterally elongated mining head 104 mounted on the boom 102, and a conveyor 106 to transport the removed coal from the seam. The boom 102 provides vertical movement of the mining head 104. The mining head 104 includes a plurality of large cutting drums 12, 14, 16 that rotate about an axis 30. In the mining head 104, the cutting drums 12, 14, and 16 are coaxially mounted on a generally cylindrical support (not shown). The cylindrical support can be encased by one or more annular support flanges 20, 22 that extend to the boom 102 of the mining machine 10. The support flanges 20 and 22 can include roller bearings (not shown) adjoining the internal annulus to facilitate rotation of the cylindrical support. In some embodiments, the support flanges are positioned in between the cutting drums 12, 14, and 16. The cutting drums 12, 14, and 16 are equipped with teeth that continuously scrape, cut, or break coal from the seam. The cutting drums 12, 14, and 16 are operatively coupled to a motor (not shown) that drives the rotatable cutting drums 12, 14, and 16.

Figure 3:
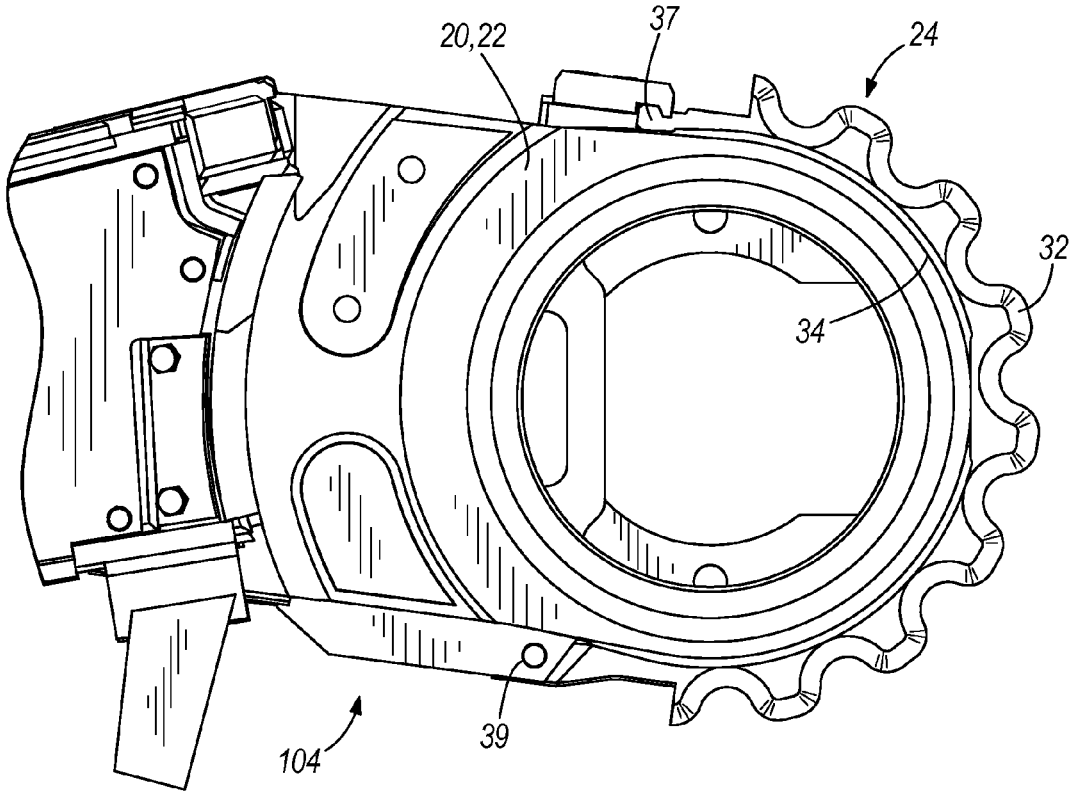
FIG. 3 is a sectional view illustrating how the core breakers of FIGS. 1 and 2 connect to a mining head of the mining machine.

The mining machine 10 also includes means for breaking up material that builds up between the cutting drums 12, 14, and 16 as the cutting drums cut into the material to be mined. In the preferred embodiment, the means for breaking up material that builds up between the cutting drums is a core breaker 24. In the embodiment shown in FIGS. 1 and 2, a core breaker 24 is positioned on each support flange 20, 22. In other embodiments, a core breaker 24 can be positioned on at least one support flange. FIG. 3 is a sectional view illustrating how the core breaker 24 of FIGS. 1 and 2 can connect to the support flanges 20 and 22 on the mining head 104.

Figure 4:
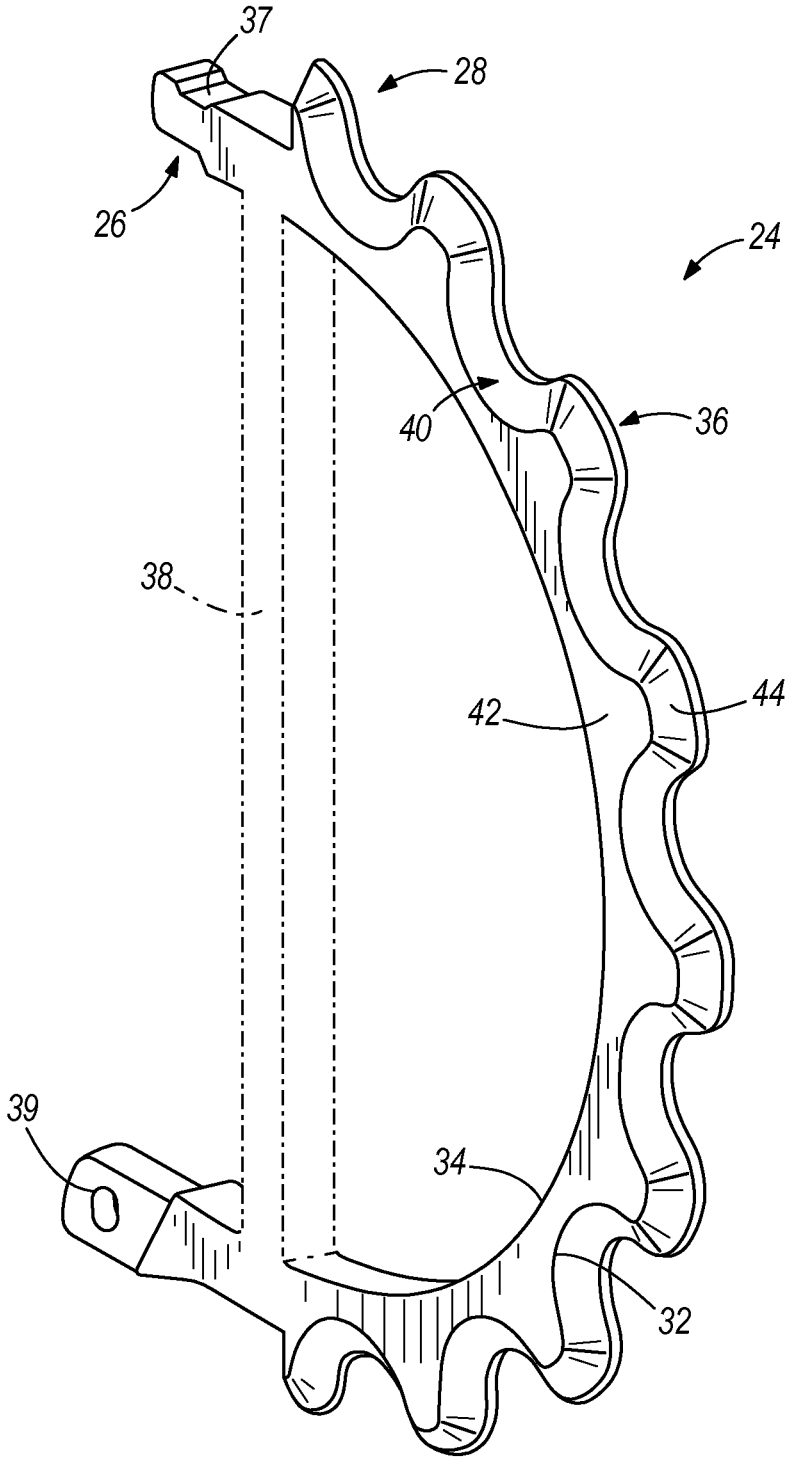
FIG. 4 is a perspective view of the core breaker of FIGS. 1 and 2.

With reference also to FIG. 4, the core breaker 24 includes a core-breaker support 26 and a serrated blade portion 28. The core-breaker support 26 generally follows the circumferential contour of a semicircle, giving the appearance of a C shape. The circle center of the semicircle is generally positioned on axis 30. The core-breaker support 26 has a radially outward surface 32 and a radially inward surface 34. On the radially outward surface 32, the core-breaker 24 includes a plurality of wedge-shaped portions 36. The radially inward surface 34 is connected to a straight portion 38 (shown in phantom lines) that runs substantially along the diameter of the semicircle. The straight portion 38 can prevent distortion during manufacturing, and is typically cut away in a finished core breaker. The core-breaker support 26 has opposite ends 37 and 39 that generally include fastening means connecting to the mining head 104. The fastening means can be a hole that receives a pin from the support flange 20, 22, a pin that inserts into a hole on the support flange 20, 22, or a groove that receives a hook portion from the support flange 20, 22. In some embodiments, one end of the core-breaker support 26 includes a fastening means different from the other end of the core-breaker support 26. In other embodiments, both ends 37 and 39 include the same fastening means.

In the embodiment shown in the drawings, the wedge-shaped portions 36 are integral with the core-breaker support 26, that is, the wedge-shaped portions 36 are generally not removable from the core-breaker support 26. In other embodiments, removable members such as bits can be secured to the core-breaker support 26, for example by welding, or other mechanical attachment, which would allow repair or replacement as they wear out or break. The wedge-shaped portions 36 are interconected with serrated portions 40, that is, each wedge-shaped portion is connected to an adjacent wedge-shaped portion by a mediate serrated portion 40. Both the wedge-shaped portions 36 and the serrated portions 40 are generally beveled. The wedge-shaped and serrated portions 36, 40 include a common surface 42 that is substantially orthogonal to the axis 30, and the common surface 42 is jointed to an obtusely angled surface 44 such that the cross section of the blade portion 28 tapers gradually in the radial outward direction. In some embodiments, the common surface 42 is jointed to the angled surface 44 at an angle ranging between about 100 degrees and about 155 degrees. In other embodiments, the common surface 42 is jointed to the angled surface 44 at an angle ranging between about 140 degrees and about 155 degrees. The surface 42 that is substantially orthogonal to the axis 30 generally follows the radially convex and concave profile of the portions 36, 40. The wedge-shaped portions 36 and serrated portions 40 maintain curvatures, giving the blade portion 28 a generally undulated appearance of peaks and valleys.

Figure 5:
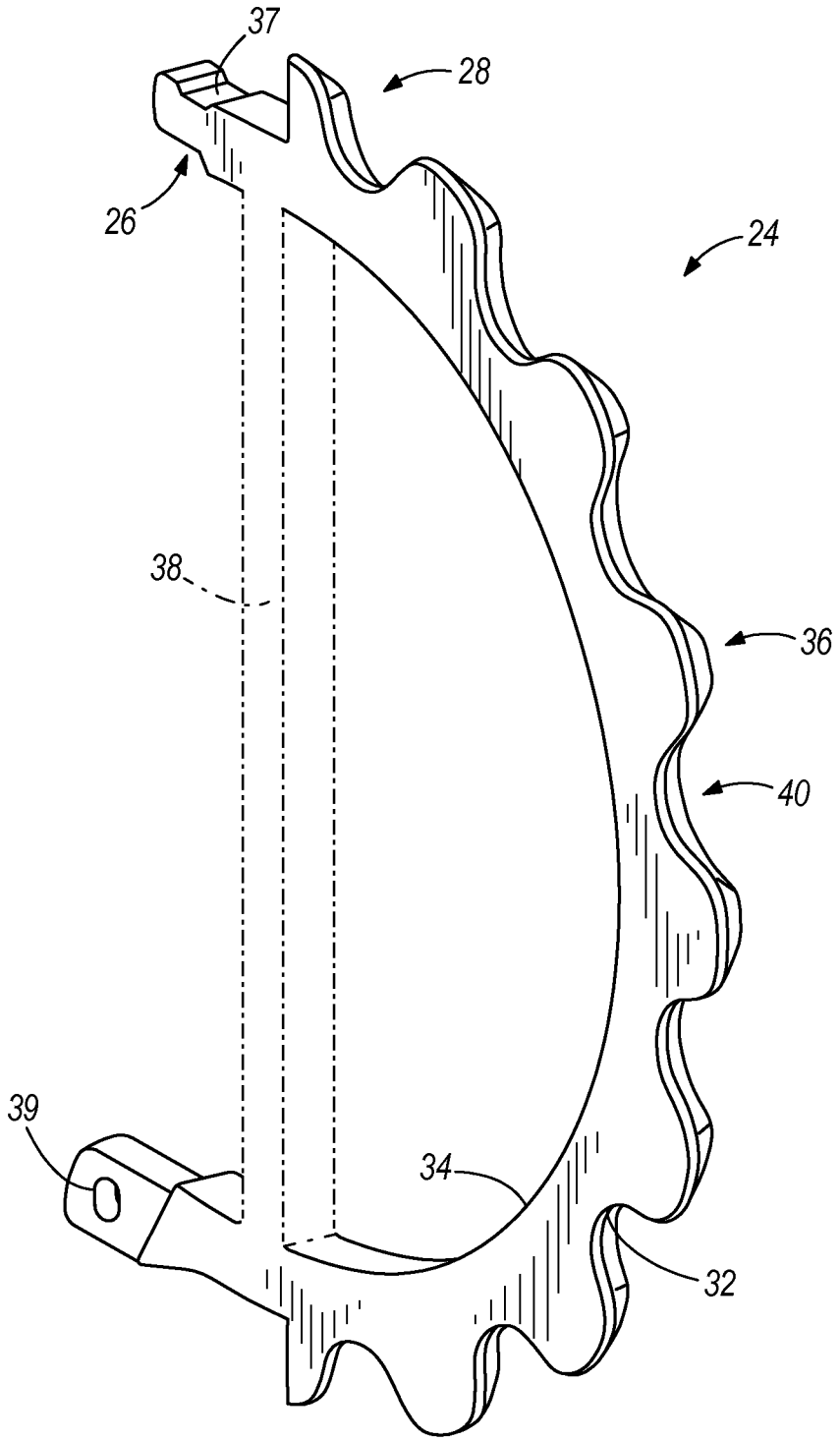
FIG. 5 is a perspective view similar to FIG. 4 but illustrating an embodiment beveled on a single face.

Referring to FIGS. 4 and 5, the blade portion 28 includes two faces that are substantially orthogonal to the axis 30. In some embodiments, the blade portion 28 includes an angled surface 44 on each face. In further embodiments, the two angled surfaces are substantially symmetrical from a view in the radial direction. In still further embodiments, the two angled surfaces are substantially asymmetrical from a view in the radial direction. In other embodiments, shown in FIG. 5, the blade portion 28 includes an angled surface 44 on a single face. In embodiments beveled on a single face, the face that does not include an angled surface can remain substantially flush or flat from the core-breaker support 26 to the serrated blade portion 28. A blade portion 28 beveled on one face can be easier to manufacture, and can help force the core to one side.

Other embodiments (not shown) can include any core breaker or support flange that does not present a flat or cylindrical surface to the material being cut into by the mining machine; that is, a surface generally parallel to the axis 30 that would prevent the cutting teeth from penetrating the coal seam. Various features and advantages of the invention are set forth in the following claims.

What is claimed is:

1. A core breaker positioned between cutting drums on a mining machine, the cutting drums rotating about a common axis, the core breaker comprising:

a generally circular support member defining radially inward and outward ends; and a beveled blade portion extending from the radially outward end, wherein the beveled blade portion includes a plurality of wedge-shaped portions and a plurality of beveled serrated portions, and wherein each wedge-shaped portion is connected to an adjacent wedge-shaped portion through one of the plurality of beveled serrated portions.

2. The core breaker of claim 1, wherein the plurality of wedge-shaped portions and the plurality of beveled serrated portions include a common surface that is substantially orthogonal to the axis, and wherein the common surface is jointed to an angled surface such that the cross section of the wedge-shaped and beveled serrated portions tapers gradually in the radial outward direction.

3. The core breaker of claim 2, wherein the common surface is jointed to the angled surface at an angle ranging between about 100 degrees and about 155 degrees.

4. The core breaker of claim 2, wherein the blade portion has two faces that are substantially orthogonal to the axis, and wherein the blade portion includes an angled surface on each face.

5. The core breaker of claim 4, wherein the angled surfaces are substantially symmetrical from a view in the radial direction.

6. The core breaker of claim 2, wherein the blade portion has two faces that are substantially orthogonal to the axis, and wherein the blade portion includes an angled surface on a single face.

7. A mining machine comprising:

a plurality of cutting drums that rotate about an axis;

one or more support flanges, each support flange positioned between two cutting drums; and a core breaker mounted on at least one support flange, the core breaker including a generally circular support member defining radially inward and outward ends, and a beveled blade portion extending from the radially outward end, wherein the beveled blade portion includes a plurality of wedge-shaped portions and a plurality of beveled serrated portions, and wherein each wedge-shaped portion is connected to an adjacent wedge-shaped portion through one of the plurality of beveled serrated portions.

8. The mining machine of claim 7, wherein the plurality of wedge-shaped portions and the plurality of beveled serrated portions include a common surface that is substantially orthogonal to the axis, and wherein the common surface is jointed to an angled surface such that the cross section of the wedge-shaped and beveled serrated portions tapers gradually in the radial outward direction.

9. The mining machine of claim 8, wherein the common surface is jointed to the angled surface at an angle ranging between about 100 degrees and about 155 degrees.

10. The mining machine of claim 8, wherein the blade portion has two faces that are substantially orthogonal to the axis, and wherein the blade portion includes an angled surface on each face.

11. The mining machine of claim 10, wherein the angled surfaces are substantially symmetrical from a view in the radial direction.

12. The mining machine of claim 8, wherein the blade portion has two faces that are substantially orthogonal to the axis, and wherein the blade portion includes an angled surface on a single face.

13. A mining machine comprising:

a plurality of cutting drums that rotate about an axis;

one or more support flanges, each support flange positioned between two cutting drums; and a means for breaking up material between the cutting drums as the cutting drums cut into the material to be mined, wherein the means for breaking up material includes a plurality of wedge-shaped portions and a plurality of beveled serrated portions, and wherein each wedge-shaped portion is connected to an adjacent wedge-shaped portion through one of the plurality of beveled serrated portions.

14. The mining machine of claim 13, wherein the plurality of wedge-shaped portions and the plurality of beveled serrated portions include a common surface that is substantially orthogonal to the axis, and wherein the common surface is jointed to an angled surface such that the cross section of the wedge-shaped and beveled serrated portions tapers gradually in the radial outward direction.

15. The mining machine of claim 14, wherein the common surface is jointed to the angled surface at an angle ranging between about 100 degrees and about 155 degrees.

* * * * *